United States Patent [19]

Patterson et al.

[11] 4,058,053

[45] Nov. 15, 1977

[54] STRAP GUIDE FOR STRAPPING MACHINE

[75] Inventors: Francis J. Patterson, Calumet City; Louis M. DeFilippo, Chicago Ridge, both of Ill.

[73] Assignee: Interlake, Inc., Oak Brook, Ill.

[21] Appl. No.: 756,872

[22] Filed: Jan. 5, 1977

[51] Int. Cl.[2] ..... B65B 57/10; B65B 13/04; B65B 13/34

[52] U.S. Cl. ..... 100/26; 100/33 PB

[58] Field of Search ..... 100/4, 25, 26, 33 R, 100/33 PB, 30

[56] References Cited

U.S. PATENT DOCUMENTS

| | | | |
|---|---|---|---|
| 3,269,300 | 8/1966 | Billett et al. | 100/8 |
| 3,768,397 | 10/1973 | Plattner | 100/30 |
| 4,011,808 | 3/1977 | Aoki et al. | 100/26 |

*Primary Examiner*—Leonard D. Christian
*Attorney, Agent, or Firm*—Vogel, Dithmar, Stotland, Stratman & Levy

[57] ABSTRACT

Strap guide apparatus for use in a strapping machine for applying plastic strap in a loop around an object is adapted for guiding the strap to a sealing region both from a strap supply and from the loop about the object to provide overlapping strap portions in the sealing region to be sealed together. The guide apparatus includes a plastic feed track member and first and second plastic guide members which are located adjacent to the sealing region. The first guide member provides a strap channel which is covered by the second guide member to provide a strap passage from an inner track surface of the feed track member to the sealing region. The second guide member has an outer guide surface which cooperates with an outer track surface on the feed track member to guide the leading end of the strap from the loop back to the sealing region in spaced-apart overlapping relationship with the supply portion of the strap.

16 Claims, 6 Drawing Figures

STRAP GUIDE FOR STRAPPING MACHINE

BACKGROUND OF THE INVENTION

The present invention relates to strapping machines for applying strap in a loop around an object, tensioning the strap, severing the supply portion and sealing together the ends of the tensioned loop.

More particularly, the present invention relates to a machine for applying plastic strap around an object, wherein the overlapping loop ends are secured together by heat sealing, the invention relating specifically to apparatus for guiding the strap to the sealing region from a strap supply and from the loop about the object.

A typical strapping machine of the type with which the present invention could be used is manufactured by Interlake, Inc., the assignee of the present invention, and is described in an Interlake instruction manual entitled "G18 Strapping Head" (Form 1256), copyright 1976. In that strapping machine, the guide members for guiding the plastic strap to the sealing region from the strap supply and from the loop around the object are typically formed of steel. Those guide members have exhibited an abrasive or cutting effect on the plastic strap being guided thereby. More particularly, it has been found that small pieces of the plastic strap have been abraded or chipped away by the guide members and have accumulated in the strap guide passage therethrough, thereby obstructing the path of the strap along the guide members and tending to jam the machine.

Some success has been experienced in overcoming this problem by chrome-plating the guide surfaces of the guide members, but this is a very expensive process and, therefore, has not proven to be economically feasible. A need has, therefore, arisen for a means to provide accurate guiding of the plastic strap through the strapping machine without adversely affecting the strap and at the same time providing essentially jam-free operation.

SUMMARY OF THE INVENTION

The present invention provides economical guide apparatus for a strapping machine to apply plastic strap around an object, which guide apparatus avoids the disadvantages of the prior art guide apparatus.

It is a general object of the present invention to provide guide apparatus for a strapping machine to apply plastic strap which does not adversely affect the condition of the strap and is, at the same time, free of the jamming tendencies characteristic of the prior art apparatus.

More particularly, it is an object of the present invention to provide strap guide apparatus which is compatible with the plastic material of the strap so as to provide free and unobstructed passage of the strap therealong.

It is another object of this invention to provide strap guide apparatus of the character described, wherein the strap guide apparatus is formed of plastic.

Another object of this invention is to provide strap guide apparatus which is of simple and economical construction and is characterized by ease of assembly, and which provides a strap passage therethrough.

These objects are achieved by providing a plastic guide block which has a strap passage formed therethrough for guiding strap from the strap supply to the sealing region, and having an outer strap guide surface for guiding the strap from the loop back to the sealing region.

Further features of the invention pertain to the particular arrangement of the parts of the strap guide apparatus whereby the above-outlined and additional operating features thereof are attained.

The invention, both as to its organization and method of operation, together with further objects and advantages thereof, will best be understood by reference to the following specification taken in connection with the accompanying drawings.

DESCRIPTION OF THE PREFERRED EMBODIMENT

Figure 1:
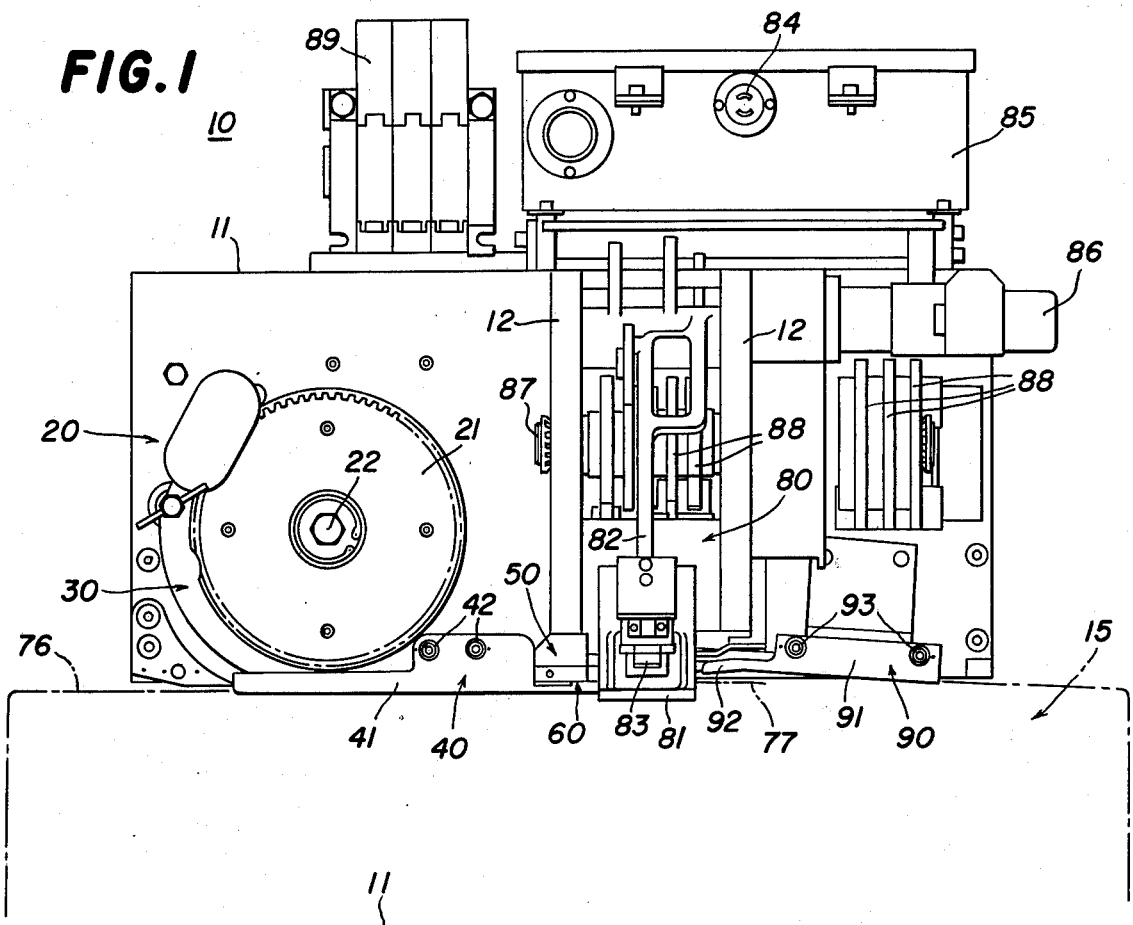
FIG. 1 is a side elevational view of a strapping machine utilizing the strap guide apparatus of the present invention.
Figure 2:
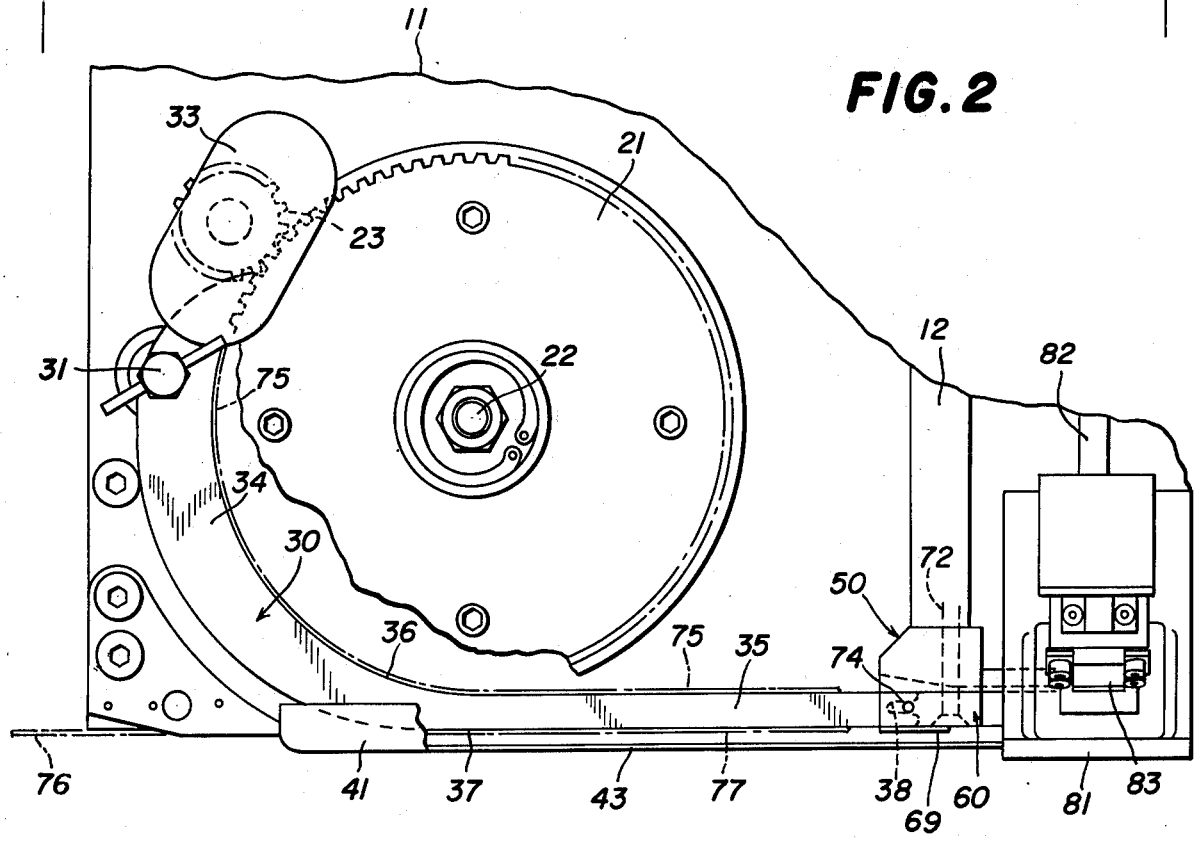
FIG. 2 is an enlarged fragmentary view of the portion of the strapping machine of FIG. 1 which includes the strap guide apparatus of the present invention.
Figure 3:
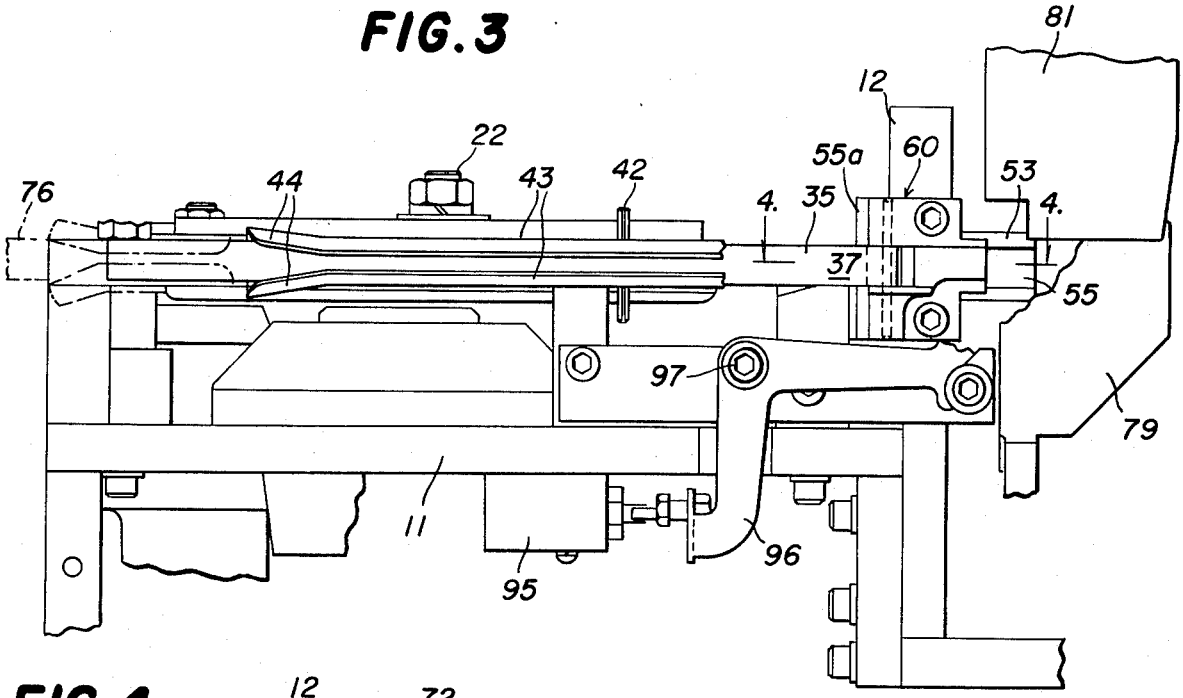
FIG. 3 is a fragmentary bottom plan view of the portion of the strapping machine illustrated in FIG. 2.

Referring now to FIGS. 1, 2 and 3 of the drawings, there is illustrated a strapping machine, generally designated by the numeral 10, for use in applying plastic strap in a loop around an object, generally designated by the numeral 15. The construction and operation of the strapping machine 10 is described in detail in the aforementioned Interlake instruction manual entitled "G18 Strapping Head" and, therefore, only so much of the construction and operation of the strapping machine 10 as is necessary for a complete understanding of the present invention will be described herein.

The strapping machine 10 has a frame including a main frame plate 11 having secured thereto two side frame plates 12. Mounted on the main frame plate 11 is a strap feed mechanism, generally designated by the numeral 20, which includes a feed wheel 21 rotatably mounted on a shaft 22, the periphery of the feed wheel 21 having a circumferentially toothed portion which is disposed for meshing engagement with a rotary dog 23, which is in turn mounted for rotation about the shaft of an air motor (not shown) which is mounted on the opposite side of the main frame plate 11 for rotatably driving the rotary dog 23 and thereby the feed wheel 21. The rotary dog 23 and the feed wheel 21 are each also provided with strap feed rings which pinch the strap therebetween to feed it to the machine.

Mounted adjacent to the lower portion of the perimeter of the feed wheel 21 is a feed track member, generally designated by the numeral 30, which is secured to the main frame plate 11 by a lock pin 31 and is formed of a plastic material. Extending forwardly from the upper end of the feed track member 30 is a shaft 32 (see FIG. 6), to which is fixedly secured a cover plate 33 for covering the rotary dog 23 and the region in which it engages the feed wheel 21. The feed track member 30 has an arcuate entry end 34 and a straight exit end 35 and includes an inner track surface 36 which extends along the entire length of the feed track member 30. The portion of the inner track surface 36 along the arcuate entry end of the feed track member 30 is substantially concentric with the feed wheel 21 and has a radius only slightly greater than the radius of the feed wheel 21. The portion of the inner track surface 36 along the straight exit end of the feed track member 30 is disposed substantially horizontally in use. The feed track member 30 also includes an outer track surface 37 on the outer or underside thereof which is disposed substantially parallel to the straight portion of the inner track surface 36 and is spaced a predetermined distance therefrom in the direction of the object 15 to be strapped. Formed in the exit end of the feed track member 30 is a horizontal slot 38 for a purpose to be described more fully below.

Secured to the main frame plate 11 respectively on opposite sides of the straight exit portion of the feed track member 30 are two retaining side plates, each generally designated by the numeral 40. Each of the side plates 40 includes a side wall 41 which is disposed substantially parallel to the main frame plate 11 and is secured thereto by a mounting pin and spring assemblies 42 which accommodate pivotal movement of the lower ends of the side plates 40 toward and away from each other, while resiliently urging the side plates 40 toward a retaining position illustrated in the drawings wherein the side walls 41 are disposed substantially parallel to each other. Integral with each of the side walls 41 along the bottom edge thereof and extending inwardly therefrom substantially normal thereto is a bottom flange 43, the inner edges of the bottom flanges 43 preferably being spaced apart a predetermined distance in the normal retaining position thereof (see FIG. 3). Each of the side plates 40 has an entry end disposed toward the arcuate entry end of the feed track member 30, the entry ends of the side plates 40 being outwardly flared as at 44 to facilitate passage of the strap therebetween, as will be described more fully below. It will be observed that in the normal retaining positions thereof, the bottom flanges 43 of the side plates 40 are disposed substantially in a common place spaced a predetermined distance below the outer track surface 37 of the feed track member 30 and substantially parallel thereto.

Figure 4:
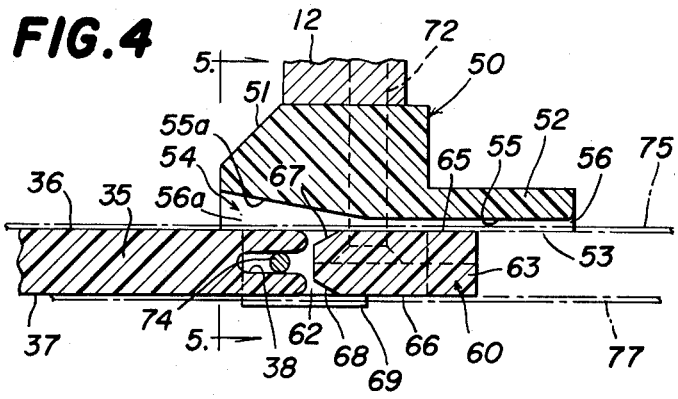
FIG. 4 is a fragmentary view in vertical section taken along the line 4—4 in FIG. 3 and illustrating the cooperation of the several parts of the strap guide apparatus of the present invention.
Figure 5:
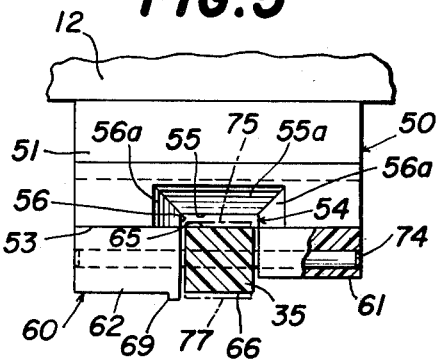
FIG. 5 is a fragmentary view in vertical section taken along the line 5—5 in FIG. 4.
Figure 6:
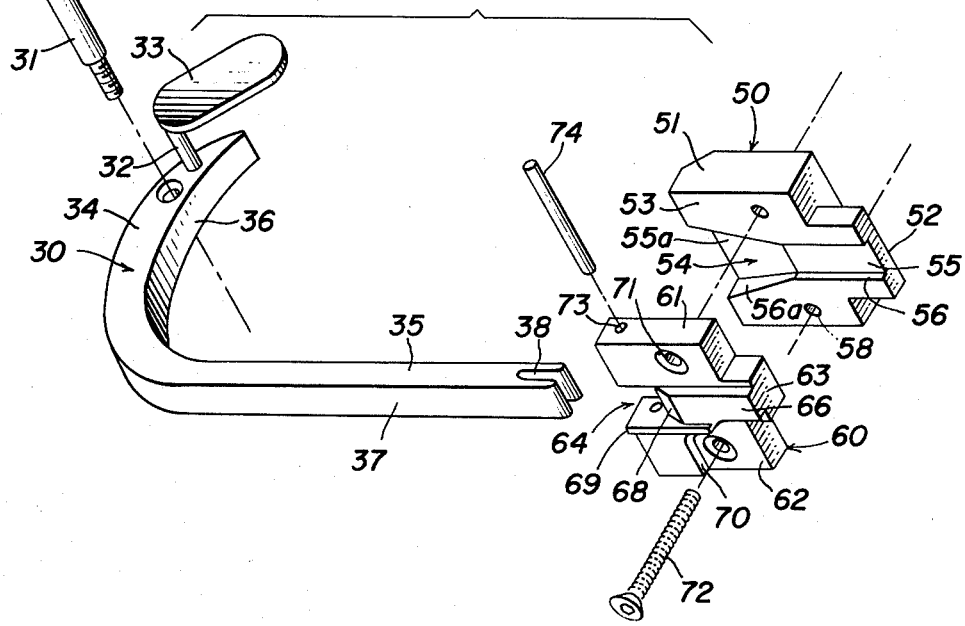
FIG. 6 is an exploded view of the strap guide apparatus illustrated in FIGS. 2, 4 and 5.

Referring now also to FIGS. 4 through 6 of the drawings, there is illustrated a guide member, generally designated by the numeral 50, which is preferably integrally formed of a solid piece of plastic material. The guide member 50 includes a body portion 51 and a reduced cross-section tongue portion 52 integral with the body portion 51 and extending therefrom at one end thereof. The body portion 51 and tongue portion 52 have a common outer surface 53 which has recessed therein a strap channel, generally designated by the numeral 54. The strap channel 54 is generally rectangular in transverse cross section and is defined by a bottom surface 55 and a pair of opposed side surfaces 56 which respectively interconnect the outer surface 53 with the opposite side edges of the bottom surface 55. In use, the guide member 50 is disposed closely adjacent to the exit end of the feed track member 30 with the strap channel 54 being disposed in longitudinal alignment therewith, and with the portion of the strap channel 54 passing through the tongue portion 52 being disposed at the exit end thereof. The bottom surface 55 and the side surfaces 56 are respectively provided with outwardly flared entry portions **55*a* and 56*a* to facilitate entry of the strap thereinto, as will be described in greater detail below. A pair of screw holes 58 are formed through the body portion 51 substantially perpendicular to the outer surface 53 for attachment of the guide member 50 to the machine 10**.

There is also provided a guide member, generally designated by the numeral 60, which is preferably formed integrally of a single piece of plastic material. The guide member 60 includes two wing portions 61 and 62 interconnected by a center portion 63 which is longitudinally offset with respect to the wing portions 61 and 62 so as to project therefrom at one end thereof and to cooperate therewith at the other end thereof to define a slot or recess 64. The wing portions 61 and 62 and center portion 63 all have a common inner guide surface 65 which is disposed in use in facing engagement with the outer surface 53 of the guide member 50. The longitudinal extent of the guide member 60 is less than that of the guide member 50, and they are mounted together so that the exit ends of the wing portions 61 and 62 are substantially coplanar with the exit end of the body portion 51 of the guide member 50, and with the center portion 63 of the guide member 60 being disposed in alignment with the tongue portion 52 of the guide member 50, but terminating short of the exit end thereof.

Formed on the center portion 63 is an outer guide surface 66 which is substantially parallel to the inner guide surface 65, with the distance therebetween being substantially the same as the distance between the inner and outer track surfaces 36 and 37 of the feed track member 30. The entry end of the portion of the inner guide surface 65 along the center portion 63 is beveled as at 67 and the entry end of the outer guide surface 66 is beveled as at 68. Integral with the guide member 60 along one side edge of the center portion 63 and extending downwardly therefrom substantially normal to the outer guide surface 66 is a guide ridge 69. The outer surface of the wing portion 62 is recessed as at 70, and formed through the wing portions 61 and 62 are screw holes 71 which are disposed for alignment with the screw holes 58 in the guide member 50 to receive screws 72 therethrough securely to fasten the guide members 50 and 60 to each other and to the machine 10. Coaxial bores 73 are formed through the wing portions 61 and 62 forwardly of the entry end of the center portion 63 for receiving therethrough a roll pin 74.

In operation, the feed track member 30 and the guide members 50 and 60 are assembled together with the exit end of the feed track member 30 received in the slot 64 of the guide member 60 and with the roll pin 74 received in the slot 38 in the exit end of the feed track member 30 so that the exit end of the feed track member 30 is positioned closely adjacent to the entry end of the center portion 63 of the guide member 60. When thus assembled, the inner guide surface 65 of the guide member 60 covers a portion of the strap channel 54 in the guide member 50 and cooperates therewith to form an enclosed strap passage dimensioned to accommodate movement of the strap therethrough. As illustrated in FIG. 4, when the feed track member 30 and the guide members 50 and 60 are assembled together, the inner and outer guide surfaces 65 and 66 of the guide member 60 are respectively disposed substantially coplanar with the exit ends of the inner and outer track surfaces 36 and 37 of the feed track member 30. Thus, the inner guide surface 65 and the inner track surface 36 cooperate to form the bottom wall or surface of the strap guide passage, the other walls of which are formed by the walls of the strap channel 54 in the guide member 50. In like manner, the retaining side plates 40 cooperate with the outer track surface 37 and outer guide surface 66 to form another strap passage.

In operation, the strap, which is formed of a plastic material such as, for example, polypropylene, is fed from an associated supply roll between the rotary dog 23 and the feed wheel 21 and is moved by the rotation thereof downwardly along the inner track surface 36 of the feed track member 30 and then into the flared entry end of the strap passage formed by the strap channel 54 in the guide member 50. Preferably, the chamber of the strap is such that it will be urged into engagement with the inner track surface 36 and the inner guide surface 65 of the guide member 60, the beveled entry end 67 of which serves to facilitate passage of the leading end 77 of the strap from the exit end of the feed track member 30 to the guide surface 65 without snagging.

From the exit end of the strap channel 54, the leading end 77 is fed into a sealing region in which a sealing operation will later be performed on the strap by a sealing mechanism, generally designated by the numeral 80. The sealing mechanism 80 includes a bottom sealer table 81 carried by the frame of the machine 10 and a sealer arm 82 which is provided at the lower end thereof with a heat sealer 83 which is connected by an electrical conductor (not shown) to a heater plug 84 in an electrical box 85 mounted atop the machine 10 for providing electrical current to the heat sealer 83. The sealer arm 82 is driven by an air motor 86 for pivotal movement between a retracted position illustrated in FIG. 1 and a sealing position for performing the sealing operation on the strap, as will be described below. The machine 10 is also provided with a rotatably driven cam shaft 87 provided with a plurality of cam plates 88 thereon which operate a series of switches for controlling the sequencing of the strapping operation by the machine 10 and for controlling the operation of a holding mechanism (not shown) for clamping the leading end 77 of the strap after it has been looped about the object 15. There is provided an extensive electrical and pneumatic network for controlling the operation of the machine and the operation of the several air motors which drive the moving parts of the machine, a valve manifold 89 being provided to control the pneumatic operation.

Disposed on the opposite side of the sealing region from the guide members 50 and 60 are a pair of exit guide plates, each generally designated by the numeral 90, and which are respectively disposed on opposite sides of the strap path from the sealing region. Each of the exit guide plates 90 is provided with a side wall 91 mounted on the main frame plate 11 by pin and spring assemblies 93 which accommodate pivotal movement of the exit guide plates 90 between a normally closed retaining position illustrated in FIG. 1 wherein the side walls 91 are disposed substantially parallel to each other and a release position wherein the bottom ends of the side walls 91 are spread apart. Integral with each of the side walls 91 at the bottom end thereof is an inwardly extending bottom wall (not shown) in the same manner as was described above with respect to the guide plates 40. Each of the exit guide plates 90 is provided with an entry lip portion 92 angled to facilitate entry of the leading end 77 of the strap therebetween from the sealing region. Also provided at the bottom of the machine 10 is a track switch 95 which is coupled to a track switch lever 96 pivotally mounted as at 97 for sensing movement of the strap through the sealing region to control sequencing of the machine 10.

As the leading end 77 of the strap is fed through the sealing region from the strap channel 54 it enters between the exit guide plates 90 and is guided thereby downwardly along the upper side of the object 15. There may be provided auxiliary guide track mechanism (not shown) for guiding the strap around the object 15 to be strapped. As the leading end of the strap returns from its loop around the object 15, it enters between the entry ends of the guide plates 40 and into the passage between the bottom flanges 43 of the guide plates 40 and the outer track surface 37 of the feed track member 30, being guided therealong to the outer guide surface 66 of the guide member 60 and thence back into and through the sealing region, the beveled entry end 68 of the outer guide surface 66 serving to facilitate passage of the leading end 77 of the strap thereto without snagging. It will be noted that the guide ridge 69 of the guide member 60 cooperates with the side wall 41 of the opposite one of the retaining side plates 40 to limit lateral movement of the strap as it passes along the outer guide surface 66.

At this point, it will be noted that there is formed a complete loop of strap around the object 15, including a supply portion 75, a loop portion 76 and a leading end 77, the leading end 77 being disposed in spaced-apart overlapping relationship with the supply portion 75 by the operation of the feed track member 30 and the guide members 50 and 60. There is preferably also provided spacer means (not shown) in the sealing region to maintain the separation between the supply portion 75 and the leading end 77 of the strap in the sealing region. The leading end 77 of the strap exits the sealing region and passes through a holding mechanism (not shown) which is brought into firm clamping engagement with the leading end 77 of the strap. At this point, the direction of rotation of the feed wheel 21 is reversed for tensioning the strap around the object 15. Then the heat sealer 83 is moved to its sealing position between the overlapping strap portions 75 and 77 which are then pressed firmly against the heat sealer for melting the facing surfaces of the overlapping strap portions. The heat sealer 83 is then retracted and the melted overlapping strap portions are pressed together for forming a weld-type heat seal therebetween. The supply portion of the strap is severed upstream of the seal and the strapped object 15 may then be removed and a new one inserted in its place.

It will be noted that the spring-loaded pivotal mounting of the guide plates 40 and 90 permit them to be spread apart and, therefore, permit the strap to be pulled from therebetween during the tensioning thereof so that the strap loop may be drawn as snugly as possible up against the object 15, and facilitate removal of the strapped object 15 from the machine 10 after sealing, all in a well-known manner.

It is an important feature of the present invention that each of the guide members 50 and 60 and the feed track member 30 are formed of a plastic material which cooperates with the plastic strap to accommodate smooth and free passage of the strap along the guide members 50 and 60 and the feed track member 30, the latter members having no abrasive, cutting or other adverse effect upon the strap. Thus, the strap is not weakened by its passage through the guide apparatus, nor are strap chips or filings allowed to accumulate in the strap passages obstructing the movement of the strap therethrough. Preferably, the feed track member 30 and the guide members 50 and 60 are all formed of either nylon or a thirty percent glass-filled nylon resin such as that sold under the trademark "NYLATRON", but it will be appreciated that other suitable plastic materials could be used for the construction of these members. Thus, it can be appreciated that the members 30, 50 and 60 can be easily and economically molded and will have much lighter weight than the steel parts which are normally used for strap guide apparatus in prior art devices.

From the foregoing, it can be seen that there has been provided an improved strap guide apparatus for a strapping machine to apply plastic strap about an object. More particularly, there has been provided a strap guide apparatus which is of simple and economical construction and which affords a smooth and substantially jam-free passage of the plastic strap therealong during the operation of the strapping machine.

More specifically, there has been provided strap guide apparatus formed entirely of plastic material which is capable of guiding the strap without adverse effect thereon.

There has also been provided a strap guide apparatus of the character described which includes a plastic feed track member and two plastic guide members all cooperating to form a strap passage for the supply portion of the strap and a strap guide path for the leading end of the strap to bring the leading end of the strap into spaced-apart overlapping relationship with the supply portion thereof in the sealing region of the machine.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. Strap guide apparatus for use in a strapping machine for applying plastic strap around an object with the leading end of the strap overlapping and spaced from the supply portion thereof in a strap-sealing region, said strap guide apparatus comprising a plastic guide block mounted on the machine adjacent to the strap-sealing region, a strap guide passage formed through said guide block for accommodating movement of the strap longitudinally therethrough along a predetermined path from an associated strap supply to the strap-sealing region, said guide block having a strap guide surface extending substantially parallel to said strap guide passage and spaced a predetermined distance therefrom in the direction of the associated object to be strapped, said strap guide surface guiding movement of the leading end of the strap therealong from around the associated object and back to the strap-sealing region in overlapping relationship with the portion of the strap emerging from said strap guide passage.

2. The strap guide apparatus set forth in claim 1, wherein said strap guide passage is flared outwardly toward the entry end thereof.

3. The strap guide apparatus set forth in claim 1, wherein said plastic guide block is formed of a glass-filled nylon resin.

4. The strap guide apparatus set forth in claim 1, wherein said plastic guide block is formed of nylon.

5. The strap guide apparatus set forth in claim 1, and further including a guide ridge intergral with said guide block along one side edge of said strap guide surface and extending outwardly thereform substantially normal thereto for limiting lateral movement of the strap with respect to said strap guide surface.

6. Strap guide apparatus for use in a strapping machine for applying plastic strap around an object with the leading end of the strap overlapping and spaced from the supply portion thereof in a strap-sealing region, said strap guide apparatus comprising a first plastic guide member mounted on the machine adjacent to the strap-sealing region, said first guide member having an outer surface with a strap channel recessed therein and extending the length thereof, a second plastic guide member fixedly secured to said first guide member and having an inner guide surface disposed in facing engagement with said outer surface of said first guide member, said inner guide surface covering said strap channel and cooperating therewith to define a strap guide passage for accommodating movement of the strap longitudinally therethrough along a predetermined path from an associated strap supply to the strap-sealing region, said second guide member having an outer guide surface extending substantially parallel to said strap guide passage and spaced a predetermined distance thereform in the direction of the associated object to be strapped, said outer guide surface guiding movement of the leading end of the strap therealong from around the associated object and back to the strap-sealing region in overlapping relationship with the portion of the strap emerging from said strap guide passage.

7. The strap guide apparatus set forth in claim 6, wherein the longitudinal extend of said outer surface of said first guide member is greater than the longitudinal extent of said inner guide surface of said second guide member.

8. The strap guide apparatus set forth in claim 6, wherein each of said first and second plastic guide members is formed of a glass-filled nylon resin.

9. The strap guide apparatus set forth in claim 6, wherein each of said first and second plastic guide members is formed of nylon.

10. The strap guide apparatus set forth in claim 6, and further including a guide ridge integral with said second guide member along one side edge of said outer guide surface and extending therefrom substantially normal thereto for limiting lateral movement of the strap with respect to said outer guide surface.

11. The strap guide apparatus set forth in claim 6, wherein said strap channel includes a bottom wall and a pair of opposed side walls, each of said bottom wall and side walls being flared outwardly toward the entry end of said strap channel.

12. Strap guide apparatus for use in a strapping machine for applying plastic strap around an object with the leading end of the strap overlapping and spaced from the supply portion thereof in a strap-sealing region, said strap guide apparatus comprising a plastic feed track member carried by the machine and having an entry end disposed adjacent to an associated strap supply and an exit end, said feed track member having an inner track surface for guiding the strap therealong from the associated strap supply to the exit end of said feed track member, said feed track member having an outer track surface spaced a predetermined distance from said inner track surface for guiding the strap therealong from around the associated object to the exit end of said feed track member, a first plastic guide member mounted on the machine adjacent to the exit end of said feed track member and adjacent to the strap sealing region, said first guide member having an outer surface with a strap channel recessed therein and extending the length thereof, a second plastic guide member fixedly secured to said first guide member and having an inner guide surface disposed in facing engagement with said outer surface of said first guide member and substantially coplanar with said exit end of said feed guide surface, said inner guide surface covering said strap channel and cooperating therewith to define a strap guide passage for accommodating movement of the strap longitudinally therethrough along a predetermined path from said inner track surface to the strap-sealing region, said second guide member having an outer guide surface disposed substantially coplanar with said outer track surface and extending substantially parallel to said strap passage, said outer track surface and said outer guide surface cooperating for guiding movement of the leading end of the strap therealong from around the associated object and back to the strap-sealing region in overlapping relationship with the portion of the strap emerging from said strap passage.

13. The strap guide apparatus set forth in claim 12, wherein said inner track surface includes an arcuate entry portion and a straight exit portion, said outer track surface being disposed generally parallel with the straight exit portion of said inner track surface.

14. The strap guide apparatus set forth in claim 12, wherein said inner and outer guide surfaces of said second guide member have entry ends beveled toward each other and disposed closely adjacent to the exit end of said feed track member to facilitate passage of the strap from said inner and outer track surfaces to said inner and outer guide surfaces of said second guide member.

15. The strap guide apparatus set forth in claim 12, wherein each of said first and second guide members and said feed track member is formed of a glass-filled nylon resin.

16. The strap guide apparatus set forth in claim 12, wherein each of said first and second guide members and said feed track member is formed of nylon.

* * * * *